US005383425A

United States Patent [19]

Bleacher

[11] Patent Number: 5,383,425

[45] Date of Patent: Jan. 24, 1995

[54] ANIMAL RESTRAINT DEVICE

[75] Inventor: Gary W. Bleacher, Lambertville, N.J.

[73] Assignee: American Cyanamid Company, Wayne, N.J.

[21] Appl. No.: 999,492

[22] Filed: Dec. 31, 1993

[51] Int. Cl.[6] ..... A61D 3/00

[52] U.S. Cl. ..... 119/729

[58] Field of Search ..... 119/98, 99, 100, 712, 119/729, 751, 752, 754, 755; 128/846, 869, 870

[56] References Cited

U.S. PATENT DOCUMENTS

| | | | |
|---|---|---|---|
| 975,649 | 11/1910 | Spelts | 119/98 |
| 1,443,561 | 1/1923 | Clark | 119/99 |
| 2,396,928 | 3/1946 | Parsons | 119/99 |
| 2,804,046 | 8/1957 | Turner | 119/98 |
| 3,099,249 | 7/1963 | Newhouse, Jr. | 119/99 |
| 3,237,603 | 3/1966 | Markegard | 119/99 |
| 3,319,608 | 5/1967 | Klooster | 119/98 |
| 4,655,173 | 4/1987 | Pope | 119/754 |
| 4,995,335 | 2/1981 | Wright | 119/98 |
| 5,184,572 | 2/1993 | Meier | 119/284 |

FOREIGN PATENT DOCUMENTS

| | | | |
|---|---|---|---|
| 467384 | 10/1928 | Germany | 119/751 |

*Primary Examiner*—Gene Mancene
*Assistant Examiner*—Thomas Price
*Attorney, Agent, or Firm*—Mark P. Stone

[57] ABSTRACT

A swine restraint device includes a V-shaped trough having angular blocks defining a centrally disposed, longitudinally extending channel. The angular blocks provide wedge means for supporting a swine within the trough, and at least a portion of the channel defines a bottom opening through which the feet of the swine extend when the trough is elevated relative to a stationary supporting surface. At least one yoke shaped self-adjusting back restraint cooperates with the trough to restrain a swine in a predetermined position within the trough when the trough is elevated relative to the supporting surface. A pair of opposed shoulder stops mounted in a forward position within the trough further restrain forward motion and immobilize swine within the trough. The animal restraint device is designed efficiently to humanely and temporarily immobilize animals, particularly swine, for many purposes including weighing, veterinary exams and procedures, medication, implantation, and euthanasia.

21 Claims, 1 Drawing Sheet

ANIMAL RESTRAINT DEVICE

BACKGROUND OF THE INVENTION

The present invention is directed to an animal restraint device, and in particular, a device for temporarily immobilizing swine for the purposes of implantation, veterinary examination and procedure, medication and other procedures during which it is necessary to firmly restrain the animal in a predetermined, substantially immobile position. The known or conventional animal restraint devices exhibit certain distinct disadvantages. Snares or headgates used to restrain swine are considered by some as treating the swine inhumanely. Other restraint devices support the restrained animal at its sternum which can result in discomfort and stress to the animal. The known, conventional restraint devices are not designed to efficiently immobilize the restrained animal or enhance the efficiency of the procedure or expedite the procedure being performed on the animal that is temporarily immobilized within the restraint device.

It is the primary object of the present invention to provide an animal restraint device, particularly a swine restraint device, which overcomes the known disadvantages of the conventional restraint devices. The present invention provides a swine restraint device designed to more humanely and temporarily immobilize swine restrained therein including means for laterally supporting the swine in the device. The restraint device is further designed and provided with structure to immobilize swine in a manner resulting in enhanced efficiency of the procedures performed on the restrained animal.

The objects of the invention are achieved by a design incorporating cooperating supporting and restraint structure for efficient and humane immobilization and restraint of animals within the device. Other objects and advantages of the present invention will become apparent from the following discussion in conjunction with the drawings illustrating the best mode for carrying out the invention.

SUMMARY OF THE INVENTION

An animal restraint device includes a longitudinally extending trough having inner, opposed longitudinally extending blocks having angularly inclined surfaces defining a substantially centrally disposed channel extending between said opposed blocks along a bottom surface of the trough. The channel defines a centrally disposed, longitudinally extending opening in the bottom surface of the trough, and the feet of swine restrained in the trough extend downwardly through the central opening in the bottom surface to further immobilize the swine when the trough is elevated above a predetermined fixed supporting surface. The opposed angled blocks of the trough provide surfaces for laterally supporting a swine restrained in the device, and the opposed angled blocks diverge away from each other in a direction from the front to the rear of the trough to substantially conform to the shape of the swine. The surfaces of the opposed angled blocks are smooth to eliminate traction or friction points for reducing the possibility of upward movement by the swine temporarily restrained within the device.

The restraint device further includes front and rear doors for initially confining the swine within the open-topped trough device, and further includes a pair of opposed shoulder stops. Each shoulder stop is mounted respectively to one of the opposed longitudinally extending blocks towards the front of the trough device. At least one arcuate yoke-shaped back restraint bridges the opposed angled pair of blocks within the trough, and cooperates with means for elevating the trough structure relative to the fixed supporting surface to firmly retain and restrain the swine temporarily immobilized within the restraint device.

In operation, a swine is placed within the trough, and initially restrained therein by virtue of forward and rear doors removably mounted to the front and rear ends of the trough. The trough is elevated above a fixed supporting surface on which the bottom surface of the trough initially rests by conventional elevating means such as an hydraulic lift system or a detachable chain hoist device. As the trough is raised relative to the supporting surface, the legs of the swine within the device drop through the centrally disposed opening extending longitudinally through the bottom surface of the trough, and the swine is laterally supported by the opposed angled blocks extending longitudinally through the trough. A cooperating yoke-shaped, arcuate, self-adjusting restraint element engages the back of the swine when the trough is elevated to a predetermined height, and a downwardly directed force is exerted on the swine by the restraint element to further wedge the swine into the V-shaped opened channel defined by the opposed angled longitudinally extending blocks. The swine is further immobilized by the forwardly oriented shoulder stops mounted to the opposed blocks, and also as a result of its feet extending downwardly through the centrally disposed opening in the bottom surface of the trough when the trough is elevated to a height sufficient to prevent its feet from engaging the stationary fixed supporting surface therebelow. The front and rear trough doors may be selectively removed from the restraint device to provide substantially unimpeded access to the immobilized swine for the purpose of performing a desired procedure on the restrained animal.

DISCUSSION OF THE BEST MODES FOR CARRYING OUT THE INVENTION

Figure 1:
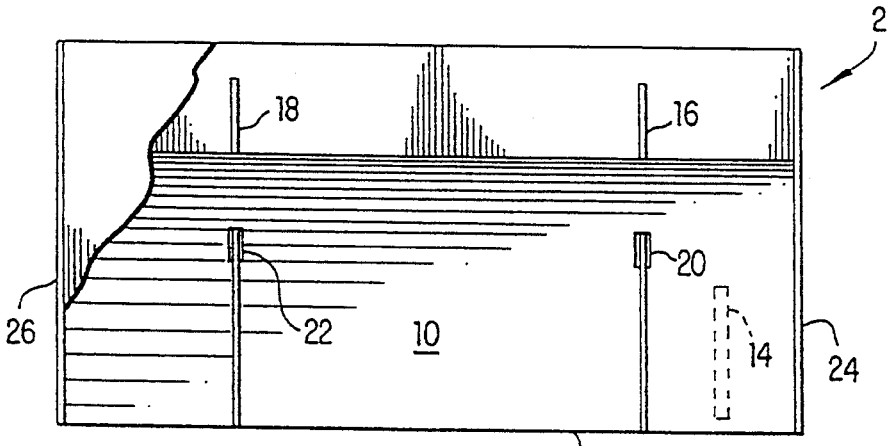
FIG. 1 of the drawing illustrates a side elevational view of an animal restraint device in accordance with the present invention.
Figure 2:
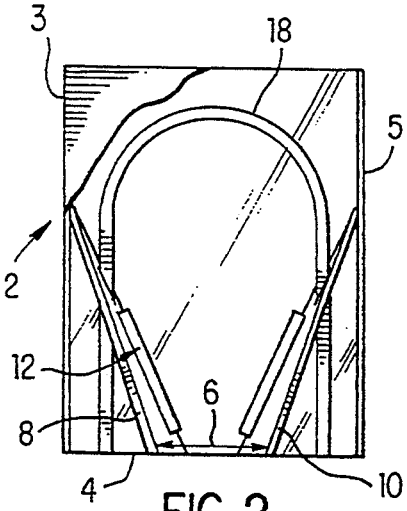
FIG. 2 illustrates a rear elevational view of the device illustrated by FIG. 1.
Figure 3:
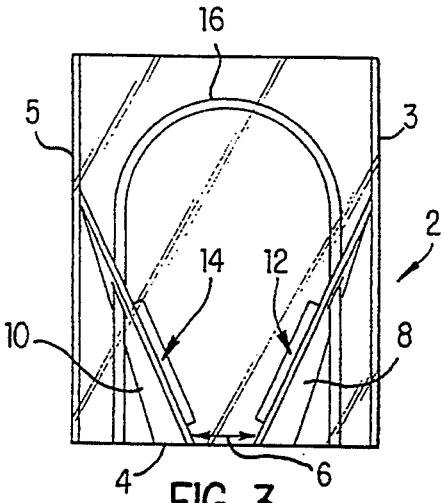
FIG. 3 illustrates a front elevational view of the device illustrated by FIG. 1.
Figure 4:
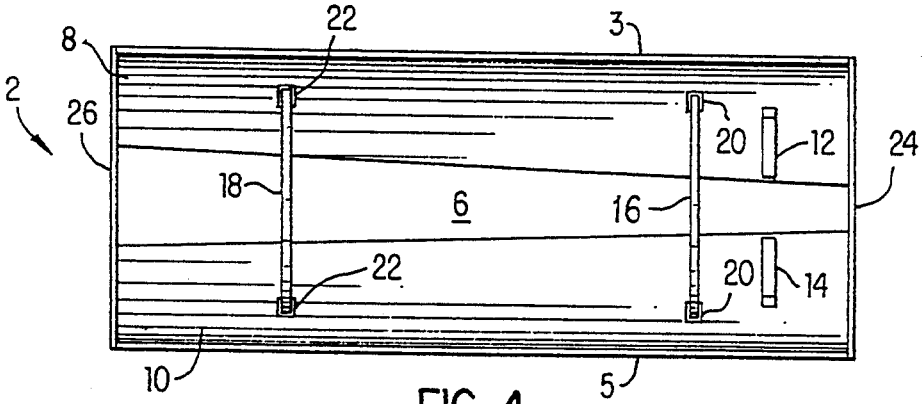
FIG. 4 illustrates a top plan view of the animal restraint device illustrated by FIGS. 1–3 of the drawing.

FIGS. 1–4 of the drawing illustrate an animal restraint device in accordance with the present invention. The device is particularly useful for temporarily restraining and immobilizing swine for the purpose of performing one or more procedures including implantation, medication, veterinary exams, veterinary procedures and euthanasia. The device is designed to reduce physical discomfort and stress to the swine, to increase the efficiency in the manner in which the procedure is performed on the animal restrained within the device, and to expedite the time required to perform the procedure by providing efficient restraint of the animal.

Referring to FIGS. 1–4 of the drawing, a swine restraint device 2 comprises a longitudinally extending, opened top trough structure. The device 2 includes a bottom surface 4 and upwardly extending opposed perpendicular sidewalls 3 and 5. As illustrated most clearly by FIG. 1, the bottom surface 4 is substantially planar and level, and is oriented substantially along a horizontal plane. An opening 6 defined in the central portion of the bottom surface 4 of the trough extends longitudinally between a front end wall 24 and a rear end wall 26 of the trough 2. The longitudinally extending opening 6, which extends substantially along the entire bottom surface 4 (see FIG. 4), diverges in a direction from the front to the rear of the trough.

The trough 2 includes two opposed blocks 8 and 10 each having a sloped or inclined angular surface. The blocks are located within the trough and extend longitudinally adjacent to trough sidewalls 3 and 5 respectively. The blocks define a substantially V-shaped cross sectional configuration of the trough, and the longitudinally extending opening 6 is defined by the space or gap between the opposed blocks 8 and As most clearly illustrated by FIG. 4, the blocks 8 and 10 each continuously narrow in width and thereby diverge from each other in a direction from the Front end 24 to the rear end 26 of the trough. As will be discussed in greater detail below, the opposed, laterally extending diverging blocks 8 and 10 provide a lateral supporting surface or wedge for a swine temporarily restrained within the device 2.

The restraint device illustrated by FIGS. 1–4 includes opposed forward shoulder stops 12 and 14. These stops are mounted respectively to forward portions of the laterally extending blocks 8 and 10, and cooperate with the blocks to restrain and temporarily immobilize a swine within the trough, as will be discussed in greater detail below. The restraint device 2 further includes a pair of back restraints 16 and 18. The back restraint 16 bridges forward portions of the laterally extending blocks 8 and 10, while the back restraint 18 bridges rear portions of the blocks 8 and 10. Each of the pair of back restraints 16 and 18 is arcuate or yoke-shaped, and the two free ends of each of the restraints are received within pairs of opposed openings defined in the respective opposed laterally extending blocks 8 and 10. As most clearly illustrated by FIG. 4, the free ends of the forward restraint 16 are received within openings 20 defined in forward portions of the opposed blocks 8 and 10, while the free ends of the rear restraint 18 are received within openings 22 defined in rear portions of the opposed blocks 8 and 10. As will be further discussed below, the free ends of each of the restraints 16 and 18 are affixed to a stationary supporting surface beneath the trough so that both restraints remain fixed relative to the trough when the trough is raised relative to the stationary supporting surface.

The trough 2, the angled blocks 8 and 10, the shoulder stops 12 and 14, and the back restraints 16 and 18 can be formed from any suitable material such as galvanized metal, sheet metal or steel. The back restraints can also include a padding material. The shoulder stops may also be formed from wood, while other components of the device may be formed from a high strength plastic. Preferably the sloped or inclined surfaces of the opposed laterally extending blocks 8 and 10 are finished to be smooth and do not include any friction or traction points. The forward portion of the centrally disposed, longitudinally extending opening 6 is approximately between 4–6 inches wide while the rearmost and widest portion of the opening is approximately between 6–8 inches. The angle of the sloping surfaces of the opposed blocks 8 and 10 illustrated in the drawing is approximately 70 degrees. Preferably, the angle of the opposed sloping surfaces of the blocks will be greater than 45 degrees (e.g., closer to vertical than horizontal). The forward end 24 and the rear end 26 of the restraint device 2 are preferably defined by removable front and rear end walls, and the front end wall is preferably formed from a transparent material such as plexiglass. The width of the diverging and longitudinally extending opening 6 defined in the center of the bottom surface 4 of the restraint device 2 is sufficiently narrow to wedge the body of the swine in the V-shaped channel defined between the opposed blocks 8 and 10, and the opening is sufficiently wide to enable the legs of the swine to extend downwardly through the opening 6 when the restraint device is elevated above a fixed supporting surface.

In operation of the restraint device illustrated by FIGS. 1–4, a swine enters the trough 2 through the rear surface thereof, and a removable rear wall 26 is thereafter mounted to the rear of the trough. A removable front end wall 24 defines the front portion of the trough. Preferably the front wall 24 is formed from a transparent material so that the swine enclosed within the open-topped trough can see outside the trough through the front wall to reduce stress and avoid panic. The swine is initially restrained by the V-shaped wedge defined between the opposed laterally extending, inclined side blocks 8 and 10. Because the sloped surfaces of the opposed blocks are smooth, any attempt by the swine to climb out of the V-shaped channel is impeded. The forwardly oriented, opposed pair of shoulder blocks 12 and 14 impede any forward movement of the swine, while the rear end wall 26 impedes any reverse movement by the swine. The rearwardly diverging configuration of the V-shaped channel defined between the opposed side blocks 8 and 10 generally conforms to the configuration of the body of the swine so as to firmly and comfortably retain the swine in the channel and also laterally support the swine by the sloping surfaces of the opposed blocks 8 and 10.

The bottom surface 4 of the restraint device 2 is initially supported by a fixed supporting surface or floor which seals the longitudinally extending opening 6. Accordingly, the legs of a swine received within the V-shaped channel wedge of the restraint device 2 are initially confined by the fixed supporting surface beneath the bottom surface of the restraint device. The restraint device of the present invention further includes conventional means for selectively elevating the trough relative to the fixed supporting surface. The means for elevating are conventional and can include a manual hoist and chain connectable to the trough for elevating the bottom surface 4 of the restraint device above the fixed supporting surface. Preferably the means for elevating will include a hydraulic lift for quickly and automatically elevating the trough above the stationary supporting surface to reduce the stress on the swine restrained within the trough and to minimize the time in which the swine is immobilized within the restraint device. The trough is raised a sufficient height above the fixed supporting surface such that the feet of the swine are fully extended beneath the bottom surface of the restraint device 4 through the central opening 6 and are maintained above the fixed supporting surface upon which the trough initially rested. In this manner, the swine enclosed within the restraint device is further immobilized because its feet are precluded from engaging any supporting surface thereunder.

When the restraint device is elevated above the fixed supporting surface and the feet of the swine extend downwardly through the central opening 6 defined in the bottom surface 4 of the trough, the swine is restrained and immobilized within the V-shaped wedge configuration as a result of gravitational forces acting thereon. Additionally, the free ends of the back restraints 16 and 18, which are respectively received within opposed openings 20 and 22 defined in the inclined blocks 8 and 10, extend through the blocks and are anchored to the fixed or stationary supporting surface upon which the bottom surface 4 of the restraint device 2 initially rests in a non-elevated position. Accordingly, as the restraint device is elevated above the fixed supporting surface, the back restraints 16 and 18 remain stationary relative to the rising bottom surface 4 of the trough. When the trough is raised to a predetermined elevation, the arcuate, upper portions of the forward and rear end back restraints 16 and 18 exert a downward force on the neck and/or back of the swine enclosed within the trough to further immobilize and restrain the swine therein.

It becomes apparent that upon elevation of the restraint device to a height at which the back restraints 16 and 18 are moved into engagement with the swine within the restraint device, the swine is immobilized as a result of 1). the V-shaped wedge in which the swine is received, the central opening in the bottom surface of the trough through which the legs of the swine extend, the gravitational forces acting downwardly on the swine, and the smooth surface of the V-shaped channel impeding upward movement of the swine: 2). the forward shoulder restraints 12 and 14 preventing forward movement by the swine; and 3). the forward and rear back restraints 16 and 18 exerting downward forces on the neck/head and back areas of the swine. As a result of the many separate restraints tending to immobilize the swine in the device of the present invention, both the front and rear end walls 24 and 26 may be selectively removed from the restraint device, as desired by the user, to provide more efficient and less impeded access to the swine within the trough. In this manner, the procedure to be conducted on the swine can be more efficiently and expeditiously performed, and the time in which the swine is immobilized is reduced thereby decreasing the stress and discomfort to the swine. The animal restraint device in accordance with the present invention restrains the animal in several different ways, as discussed above, to enable more complicated procedure, as for example, implantation into the ear of the swine, to be performed in a simplified, safe and efficient manner. The restraint device further provides better balanced, and more equally distributed support of the swine restrained therein as a result of the sloped, V-shaped opposed surfaces provided for laterally supporting the swine instead of the less desirable sternum support of the known devices.

The restraint device in accordance with the present invention advantageously immobilizes a restrained animal in a manner which reduces discomfort, stress and panic, while providing firm and secure temporary immobilization of the restrained animal thereby enabling the restraint device to be employed to efficiently and expeditiously perform procedures on the restrained animal requiring immobilization.

Other modifications and advantages of the animal restraint device within the scope of the present invention will become apparent to those skilled in the art. Accordingly, the above discussion of the best modes for carrying out the invention is intended to be illustrative only and not restrictive of the invention, that scope being defined by the following claims and all equivalents thereto.

I claim:

1. An animal restraint device comprising:

a longitudinally extending housing defining a pair of opposed lateral sidewalls;

a pair of longitudinally extending stationary elements disposed within said housing, one of said stationary elements being positioned adjacent to one of said lateral sidewalls and the other of said stationary elements being positioned adjacent to said other of said lateral sidewalls, each of said stationary elements having an inwardly sloping surface for defining a channel therebetween; and said housing having a bottom surface, said bottom surface being substantially level and oriented along a substantially horizontal plane, at least a portion of said bottom surface defining an opening between said pair of longitudinally extending stationary elements, said opening extending substantially along said entire bottom surface.

2. The animal restrain device as claimed in claim 1 wherein said channel defined by said inwardly sloping surfaces of said pair of longitudinally extending stationary elements is substantially "V" shaped in cross sectional configuration.

3. The animal restraint device as claimed in claim 1 wherein said opening defined in said housing extends longitudinally along the bottom surface of said housing.

4. The animal restraint device as claimed in claim 3 wherein said longitudinally extending opening is substantially centrally disposed along said bottom surface of said housing.

5. The animal restraint device as claimed in claim 4 wherein said stationary elements each have a bottom surface and said bottom surface of said housing is defined by the bottom surfaces of said pair of longitudinally extending stationary elements in said housing, and said longitudinally extending opening is defined by a lateral space separating said pair of longitudinally extending stationary elements.

6. An animal restraint device comprising:

a longitudinally extending housing defining a pair of opposed lateral sidewalls;

a pair of longitudinally extending stationary elements disposed within said housing, one of said stationary elements being positioned adjacent to one of said lateral sidewalls and the other of said stationary elements being positioned adjacent to the other of said lateral sidewalls, each of said stationary elements having an inwardly sloping surface for defining a channel therebetween;

said housing having a bottom surface, at least a portion of said bottom surface defining an opening between said pair of longitudinally extending elements, said opening defined in said housing extending longitudinally along the bottom surface of said housing, said longitudinally extending opening being substantially centrally disposed along said bottom surface of said housing; and said housing defining a front end and a rear end, each of said longitudinally extending stationary elements decreasing in width in a direction from said front end of said housing towards said rear end of said housing.

7. The animal restraint device of claim 6 wherein said centrally disposed opening defined in said bottom surface of said housing diverges laterally in a direction from said front end of said housing towards said rear end of said housing.

8. The animal restraint device of claim 1 wherein said housing is an opened-top trough.

9. The animal restraint device of claim 1 wherein each of said inwardly sloping surfaces of said pair of longitudinally extending stationary elements is inclined at an angle of at least 45 degrees relative to said bottom surface of said housing.

10. The animal restraint device as claimed in claim 1 wherein said housing includes a front end wall and a rear end wall, said front and said rear end walls being oriented substantially perpendicular to said pair of opposed lateral sidewalls of said housing.

11. The animal restraint device as claimed in claim 10 further including means for removably mounting at least said front end wall to said housing.

12. The animal restraint device as claimed in claim 11 wherein said removable front end wall is formed from a transparent material.

13. The animal restraint device as claimed in claim 1 further including a pair of opposed stop elements respectively mounted to said pair of longitudinally extending stationary elements in said housing, one of said stop elements mounted to one of said stationary elements and the other of said stop elements mounted to the other of said stationary elements, said pair of stop elements being mounted to said pair of stationary elements towards the forward end of said housing for restraining forward movement of an animal within said housing.

14. The animal restraint device of claim 1 wherein said inwardly sloping surfaces of said pair of longitudinally extending stationary elements are each smooth for impeding upward movement of an animal retained within said channel defined in said housing.

15. The animal restraint device as claimed in claim 1 including at least one restraining element bridging said pair of longitudinally extending stationary elements within said housing, said restraining element having two free ends, each of said free ends being received in an opening defined in a different one of said stationary elements.

16. The animal restraint device as claimed in claim 15 further including a plurality of said restraining elements, at least one of said restraining elements bridging said pair of stationary elements towards a forward end of said housing for engaging the front portion of an animal within said housing, said at least another one of said restraining elements bridging said pair of stationary elements towards a rear end of said housing for engaging the rear portion of an animal within said housing.

17. The animal restraint device as claimed in claim 15 further including means for selectively elevating said housing relative to a fixed supporting surface upon which said housing rests, and means for mounting said two free ends of said restraining element to said fixed supporting surface so that said restraining element remains in a fixed stationary position relative to said housing as said housing is elevated relative to said fixed supporting surface, wherein an animal in said housing is engaged by said restraining element when said housing is raised at least a predetermined distance above said fixed supporting surface.

18. The animal restraint device as claimed in claim 1 further including means for selectively elevating said housing so that said bottom surface of said housing is raised a predetermined elevation above a fixed supporting surface upon which said housing rests, said predetermined elevation being sufficiently high as to prevent the legs of an animal extending downwardly from said opening defined in said bottom surface of said housing from engaging against said fixed supporting surface thereunder.

19. A swine restraint device comprising a longitudinally extending trough shaped housing defining a pair of opposed lateral sidewalls, a front end housing portion and a rear end housing portion;

a pair of opposed longitudinally extending elements within said housing defining a pair of opposed inwardly sloping, inclined surfaces forming a substantially "V" shaped channel;

said housing further including a bottom surface having a longitudinally extending opening defined therein between said opposed inclined surfaces of said longitudinally extending elements; and means for selectively elevating said housing relative to a stationary supporting surface such that said bottom surface of said housing and said opening defined therein is raised above said stationary supporting surface.

20. A swine restraint device comprising a longitudinally extending trough shaped housing defining a pair of opposed lateral sidewalls, a front end housing portion and a rear end housing portion;

a pair of opposed longitudinally extending elements within said housing defining a pair of opposed inwardly sloping, inclined surfaces forming a substantially "V" shaped channel;

said housing further including a bottom surface having a longitudinally extending opening defined therein between said opposed inclined surfaces of said longitudinally extending elements;

means for selectively elevating said housing relative to a stationary supporting surface such that said bottom surface of said housing and said opening defined therein is raised above said stationary supporting surface;

at least one restraining element bridging said opposed inclined surfaces and cooperating with said means for selectively elevating said housing for exerting a downwardly directed force on an animal within said housing when said housing is elevated at least a predetermined distance above said stationary supporting surface;

said opening defined in said bottom surface of said mousing being sufficiently narrow to retain an animal within said "V" shaped channel and being sufficiently wide to permit the legs of said animal retained in said "V" shaped channel to extend downwardly through said opening; and at least one stop element mounted on each of said opposed inclined surfaces in a forward portion of said housing for restraining forward movement of an animal restrained within said housing.

21. The animal restraint device as claimed in claim 1 wherein said stationary elements comprise blocks.

* * * * *

UNITED STATES PATENT AND TRADEMARK OFFICE

CERTIFICATE OF CORRECTION

PATENT NO. : 5,383,425

DATED : January 24, 1995

INVENTOR(S) : Gary W. Bleacher

It is certified that error appears in the above-identified patent and that said Letters Patent is hereby corrected as shown below:

Title Page:

Item [22] Filed:

Delete "Dec. 31, 1993"

and substitute - -Dec. 31, 1992- -.

Signed and Sealed this

Second Day of September, 1997

*Attest:*

*Attesting Officer*

BRUCE LEHMAN

*Commissioner of Patents and Trademarks*